US007984577B2

(12) United States Patent
Arant

(10) Patent No.: US 7,984,577 B2
(45) Date of Patent: Jul. 26, 2011

(54) COMPACT EXECUTIVE ORGANIZER, AND METHOD

(76) Inventor: Gene W. Arant, Lincoln City, OR (US)

( * ) Notice: Subject to any disclaimer, the term of this patent is extended or adjusted under 35 U.S.C. 154(b) by 0 days.

(21) Appl. No.: 12/315,386

(22) Filed: Dec. 4, 2008

(65) Prior Publication Data

US 2010/0024269 A1 Feb. 4, 2010

Related U.S. Application Data

(60) Provisional application No. 61/137,613, filed on Aug. 1, 2008.

(51) Int. Cl.
*B42F 17/06* (2006.01)

(52) U.S. Cl. ..... 40/657; D6/626; 211/46; 40/371

(58) Field of Classification Search ..... 40/360, 40/374–376, 383–384; D19/75, 86, 90; 312/184; 211/46

See application file for complete search history.

(56) References Cited

U.S. PATENT DOCUMENTS 3,358,692 A * 12/1967 Proulx ..... 220/529
4,236,770 A * 12/1980 Moore et al. ..... 312/184
4,713,901 A * 12/1987 Wells et al. ..... 40/360
4,795,196 A * 1/1989 Hyun et al. ..... 283/67
4,930,928 A * 6/1990 Ristuccia, Sr. ..... 402/79
5,439,280 A * 8/1995 Steinberg et al. ..... 312/184

* cited by examiner

*Primary Examiner* — Cassandra Davis

(57) ABSTRACT

A system and method for visually representing the priorities of a number of action items in a manner which permits their priorities to be rearranged quickly and easily, utilizing individual display units supported in a rearrangeble sequence on a parallel pair of rails, and a separate note sheet removably attached to each board.

3 Claims, 2 Drawing Sheets

BOARD WITH NOTE PLACEMENT REFERENCE

BOARD WITH NOTE PLACEMENT REFERENCE

TWO BOARDS SHOWN IN SIDE VIEW WITH RELATIONSHIP TO THE SUPPORT BAR

COMPACT EXECUTIVE ORGANIZER, AND METHOD

This application claims priority of my Provisional Application Ser. No. 61/137,613 filed Aug. 1, 2008.

BACKGROUND OF THE INVENTION

Many people have a need in their homes, in their businesses, or while pursuing other activities, to keep track of a number of information items that may not be directly related to each other. Some information may be calendar items that demand immediate action; some may need action, but only at a later time; and other items may not require any action at all. Determining priorities is not always easy. Since priorities may change often, it is important to be able to reevaluate and adapt to any change in priorities quickly and efficiency.

In the present modern world much information is stored, processed, and recovered by use of computer technology of one kind or another. But computers, and the electricity to operate them, are not always available. Furthermore, some people prefer an alternative method of record keeping.

SUMMARY OF THE INVENTION

According to the present invention I provide individual information units carrying individual information items which may then be visibly displayed in a manner to indicate their present priority. Each information unit includes a display board and a note sheet that is removably attached to the board. A support frame displays the information units in a sequential relation, and permits the sequence to be easily rearranged as often as desired, when priorities appear to have changed.

According to the invention each individual note sheet has a mildly adhesive rear surface, allowing it to be easily attached to or removed from the flat supporting surface of an associated display board. Thus, note sheets may be easily replaced from time to time as desired, using the same display boards. Each note sheet preferably also has a headline area at the upper end of its front surface and a message area beneath.

Each display board is of a generally flat planar rectangular configuration with a flat front surface and a flat rear surface. Each board also has a pair of wings or flanges projecting laterally from the sides of its upper end, and hence is more generally T-shaped than rectangular. The wings provide vertical and sliding support for the board upon a parallel pair of supporting rails. A group of the display boards may then be supported in sequence upon the rails, and can easily slide when their positions are changed in order to re-adjust priorities of the associated information items.

The pair of support wings are preferably coplanar with and formed integrally with the display board, such that its wings project laterally from the respective sides of the upper end of the board.

Separation and spacing of the display boards when displayed in sequence is achieved by a pair of spacers that project forwardly from respective wings of each display board. This spacing permits a viewer to see over one display board, to see the headline area on the note sheet of the board behind it, that might otherwise be hidden, while still accommodating a reasonable number of note sheets and boards in a relatively small space. The optimum amount of space between two adjacent display boards is of the order of three-quarters of an inch.

It is preferred for the spacers to be formed integrally with the wings and main portion of their associated display board. The board with its wings and spacers may then be slidably supported upon a parallel pair of rails with the flat front surface of the board inclining rearwardly from a position of perpendicularity to the rails. It is preferred that a support surface cooperatively formed underneath the wings and spacers be longitudinally grooved to provide secure slidable support of each display unit on the rails.

It is preferred for the display boards to tilt slightly to the rear relative to the supporting rails. This provides an easier viewing of the headline on each note sheet when looking over the one in front of it. The angle of tilt should preferably be of the order of fifteen degrees from a position precisely perpendicular to the rails. When a series of note sheets are supported on their respective display boards the headline areas on the tops of the sheets are then easily visible.

Each spacer has its lower extremity flush with the undersurface of the associated wing of the board. That feature makes it possible for the wing and spacer to control the angular relation of the display board to the supporting rails. The lower extremity of each spacer and the undersurface of the associated wing cooperatively form a support surface extending at an angle to the plane of the board such that the board is in a fixed angular relation inclining rearwardly from a position of perpendicularity to the rails.

If the rails are supported so as to slope downwardly about 15 degrees toward their forward ends, as is preferred, the boards may then be exactly perpendicular to a desk or other supporting surface upon which the support frame rests.

A support frame may be so positioned as to support the pair of rails in an entirely horizontal posture, in which case the display boards are tilted rearwardly. Because of the spacer length and the separation between boards the headlines on all of the note sheets are still fully visible. Not only are they visible, but the visibility of the headline areas is very good, because of the spacing of the display boards and their rearwardly inclined relationship to the rails.

There is a particular advantage in having the spacers on the front side rather than the rear side of the display board. This makes it convenient, when writing a headline and information area on a note sheet, to lay the display board flat on a desk top with the note sheet already in place on top of the display board. The headline area of the note sheet is then directly between the spacers of the supporting display board and conveniently accessible for writing on it.

Another feature important to convenience of the user is that I prefer the forward extremities of the spacers to be smoothly rounded. This allows for the easy insertion or removal of boards from the display sequence when adding or subtracting information items, or when rearranging priorities.

DRAWING SUMMARY

DETAILED DESCRIPTION OF THE INVENTION

Figure 1:
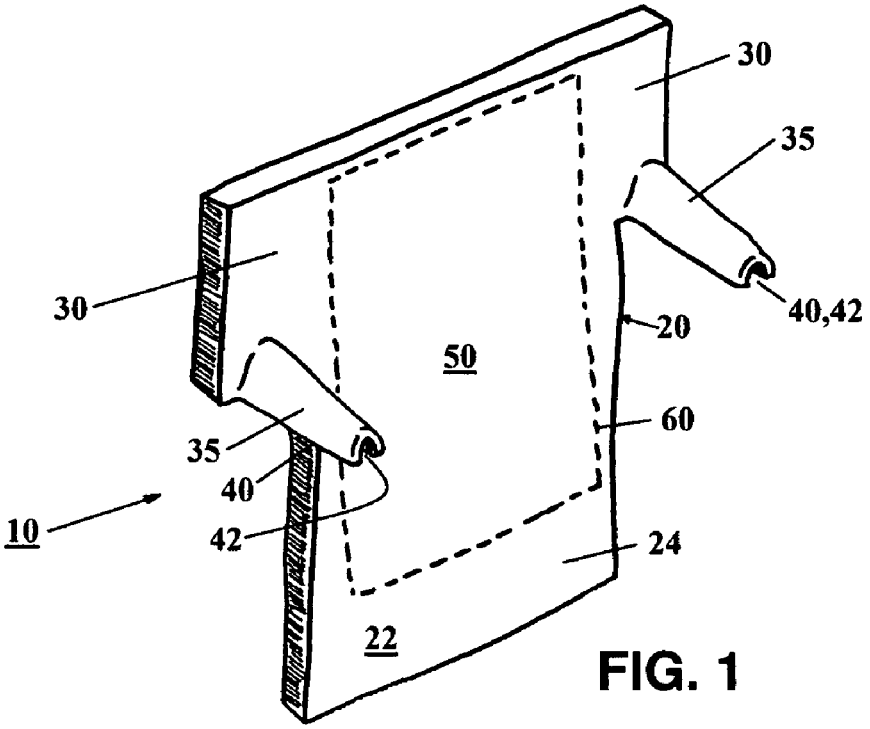
FIG. 1 is a perspective view of the presently preferred form of information unit, including a display board with integrally formed wings and spacers.

Reference is now made to FIG. 1 illustrating an information display unit 10 in accordance with the invention. A complete information display unit includes not only a display board 20 but also a note sheet 50 removably attached to it. As shown in FIG. 1, the preferred form of display board 20 has a rectangular main part 22 with a rectangular front surface 24. A similar flat back surface 26 is not directly visible in FIG. 1. Wings 30 in the plane of the board 20 have an under surface 40 which is slightly visible in FIG. 1. Dotted lines 60 indicate the borders of a note sheet when fastened to the front face 24 of the board, in between the wings 30. Spacers 35 extend forwardly from the wings 30. Both the wings 30 and the spacers 35 are formed integrally with the board 20.

Figure 2:
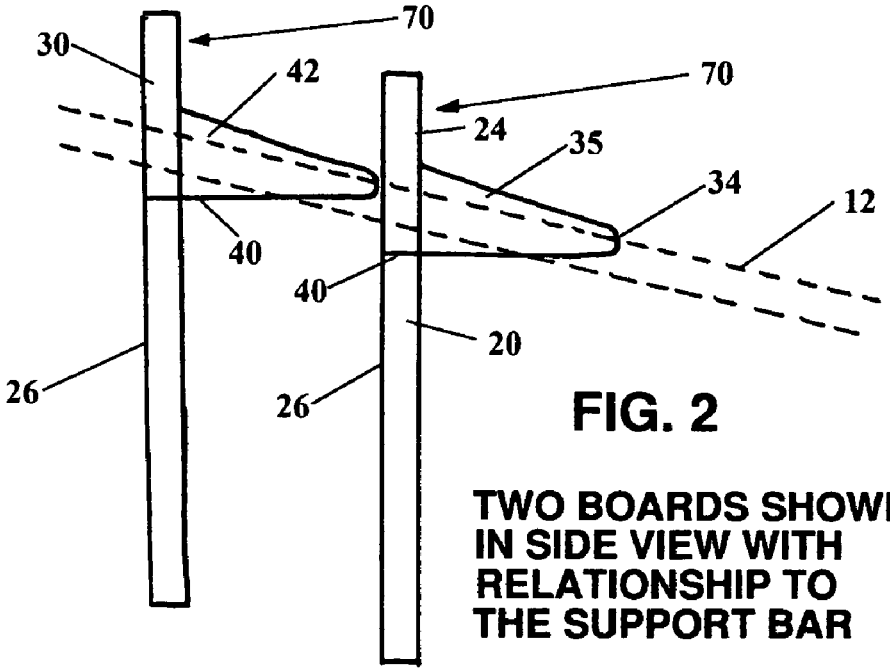
FIG. 2 is a side elevation view of two adjacent boards when supported on a pair of rails, the rails being shown only by dotted lines.

FIG. 2 is a side view of two of the display boards showing their relative positions when supported upon a pair of rails 12, indicated only by dotted lines. The flat front face 24 of each board 20 is angled at about 15 degrees relative to a position of precise perpendicularity to the rails 12. As shown in both FIGS. 1 and 2 the forward ends of spacers 35 are rounded and smooth as indicated at 34. The forward extremities of the spacers are smoothly rounded to allow the easy insertion or removal of additional boards when supported in a display sequence on rails 12.

Wings 30 and spacers 35 as shown in FIG. 1 are integrally formed with the main rectangular board part 22. A cooperatively formed support surface 40 underneath the wings and spacers is longitudinally grooved at 42 to provide secure slidable support of the display unit on the rails 12. Dotted lines 12 indicate both the position of the rails and also the upper or deep part of the cooperatively formed grooved support surface 42 whose slope is angled to hold the boards at their position of about 15 degrees from perpendicularity to the rails 12. An arrow 70 indicates a typical viewing angle by a user of the system, which enables the viewer to see the top of one display board over the one beneath or in front of it.

Figure 3:
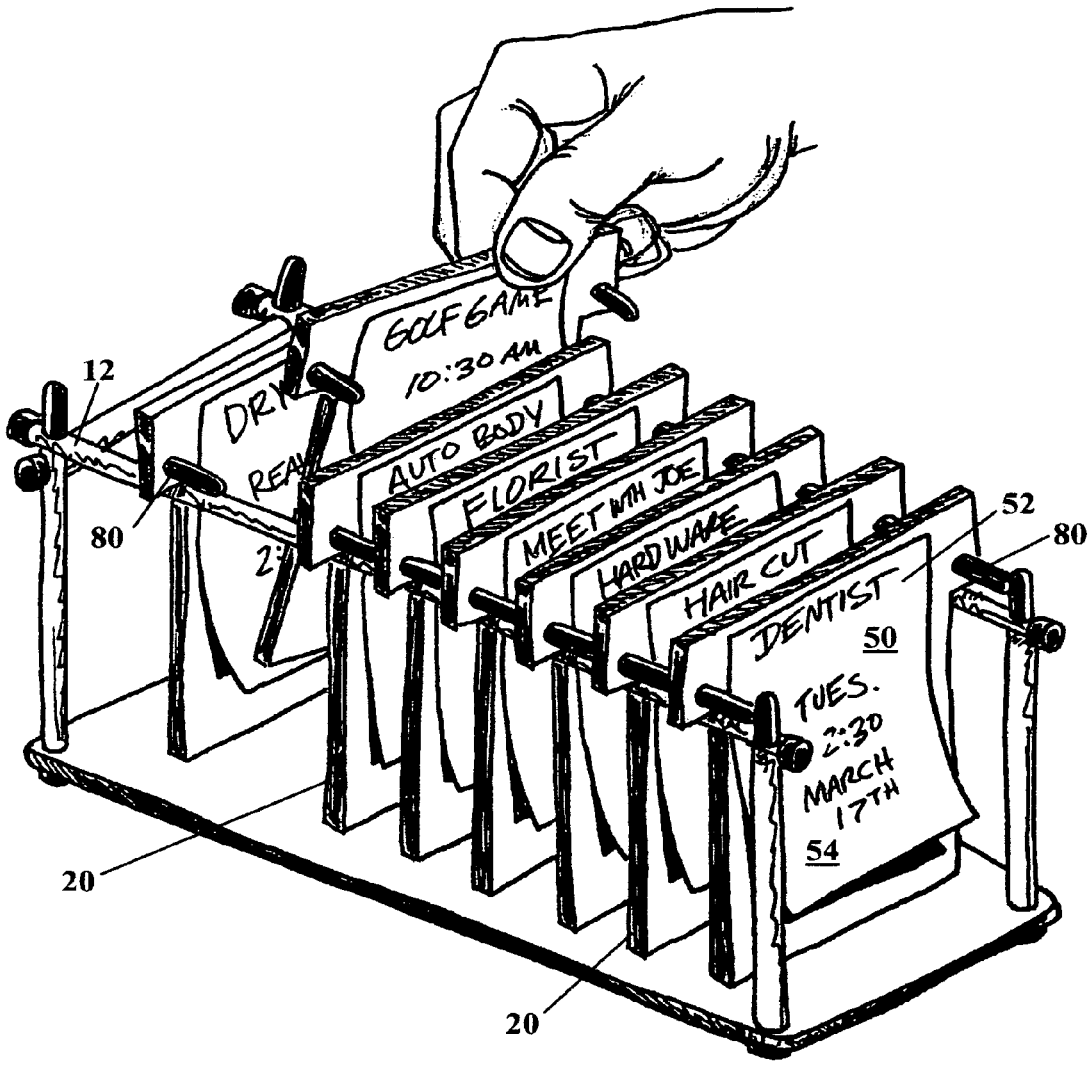
FIG. 3 is a perspective view of my new Compact Executive Organizer, illustrating its method of use and the manner of removing or adding a display board in the sequence that is being supported upon a pair of rails.

FIG. 3 is a perspective view indicating how the apparatus is used to store a sequence of display boards 20 and to rearrange the sequence of items of information as desired. Any note sheet 50 may have a headline area 52 and a message area 54. The back sides of the note sheets carry a mild adhesive coating, not specifically shown, which permits them to be temporarily attached to or removed from a corresponding display board. In FIG. 3 the spacers 80 are not integrally formed. This is an option, but not preferred.

From the illustration of FIG. 3 it is clear how the visibility of the note sheets is maintained due to the spacing between display boards and also their angular relation to the rails 12. It is also possible to attach the spacers on the rear of the wings, which again is not preferred.

The scope of the invention is to be defined only by the appended claims.

PARTS information display unit 10
display board 20
rectangular main part 22
front surface 24
rear surface 26
wings 30
under surface 40
groove 42 in 40
dotted lines 60 for note sheet position
spacers 35 rounded and smooth ends 34
rails 12
note sheet 50
headline area 52
message area 54
viewer angle 70

I claim:

1. A method of representing priorities of a number of information items in a manner which permits the priorities to be rearranged quickly and easily, comprising the steps of:

[a] selecting individual note sheets to represent the corresponding information items;

[b] writing a headline on each note sheet;

[c] selecting a plurality of display boards having wings providing a generally T-shaped configuration;

[d] removably attaching each note sheet to a front surface of a corresponding individual display board between the wings;

[e] placing a plurality of such display boards having note sheets on them in rearwardly angled and slidably supported relationship upon a pair of parallel rails; and

[f] providing spacers extending forwardly from the forward surfaces of the wings of the display boards; the spacers having an undersurface that extends at an acute angle to the front surfaces of the respective display board;

[g] the spacers being of sufficient length as to permit easy visibility of the headline of a note sheet over the top of a display board immediately beneath it.

2. In a compact apparatus for organizing information items in a visible sequence upon a pair of parallel support rails to reflect deadlines and priorities and to allow for their easy sequential arrangement as priorities change, an information display unit comprising, in combination:

[a] a flat planar generally rectangular display board having an upper end, a flat front surface and flat rear surface, and also having coplanar wings that project laterally from both sides of its upper end;

[b] a pair of spacers formed integral with respective wings of the display board and extending forwardly therefrom, the lower extremity of each spacer and the undersurface of the associated wing of the board together forming a longitudinally grooved support surface such that the board and its spacers may be slidably supported upon a parallel pair of rails;

[c] the forward extremities of the spacers being smoothly rounded to allow for the easy insertion or removal of the display board in the sequential display;

[d] a note sheet removably attached to the flat front support surface of the display board between the wings and spacers, the note sheet having a front surface with a headline area at its top;

[e] the support surface of the wings and spacers being at a fixed angle to the flat front surface of the board such that when the display board is supported on the rails its flat front surface will incline rearwardly from a position that would be precisely perpendicular to the supporting rails, so that a sequence of such information units may be supported on the pair of rails with the headline of each unit visible over the display unit in front of it; and

[f] the wings and spacers extending only forwardly from the display board and not rearwardly so that the display board may be conveniently laid on its back surface for the attachment or removal of or writing upon a corresponding note sheet.

3. In an apparatus for organizing information items in a visible sequence upon a parallel pair of support rails so as to allow their sequential positions to be easily changed when their priorities change, an information display unit comprising:

[a] a flat generally planar display board having front and back surfaces and an upper end;

[b] a pair of wing and spacer protuberances extending laterally from the respective sides of the upper end of the board, the wing portion of the protuberance having an under surface adapted to support the board in slidable relation upon a corresponding one of the rails, and the spacer portion extending forwardly so as to provide sufficient space in front of the board for the front surface at its upper end to be viewed above the top of a similar display board that may be in front of it;

[c] the front surface of the upper end of the board being adapted to have information written thereon, or on a note removably attached thereto; and

[d] the wings and spacers extending only forwardly and not rearwardly so that the flat back surface of the board is adapted to conveniently support the board when information is to be written upon its upper front surface or a note is to be attached thereto or removed therefrom;

wherein the under surface of each spacer extends at an acute angle to the front face of the board.

* * * * *